US006004180A

United States Patent [19]

Knall et al.

[11] Patent Number: 6,004,180

[45] Date of Patent: Dec. 21, 1999

[54] CLEANING OF ELECTRON-EMISSIVE ELEMENTS

[75] Inventors: N. Johan Knall, Sunnyvale; John D. Porter, Berkeley; Colin D. Stanners, San Jose; Christopher J. Spindt, Menlo Park; Victoria A. Bascom, Newman, all of Calif.

[73] Assignee: Candescent Technologies Corporation, San Jose, Calif.

[21] Appl. No.: 08/940,873

[22] Filed: Sep. 30, 1997

[51] Int. Cl.[6] ..... H01J 9/38

[52] U.S. Cl. ..... 445/59; 445/50; 445/6

[58] Field of Search ..... 445/6, 50, 59; 134/2, 3, 4, 1.1, 1.2, 19, 11, 31, 21, 25.4, 37, 41

[56] References Cited

U.S. PATENT DOCUMENTS

| | | | |
|---|---|---|---|
| 4,919,157 | 4/1990 | Mateias | 445/59 |
| 5,463,271 | 10/1995 | Geis et al. | 313/346 |
| 5,470,266 | 11/1995 | Stanley et al. | 445/59 |
| 5,605,484 | 2/1997 | Bailey et al. | 445/59 |
| 5,853,492 | 12/1998 | Cathey et al. | 134/3 |

OTHER PUBLICATIONS

Cochran, et al, "Low–voltage field emission from tungsten fiber arrays in a stabilized zirconia matrix," *J. Mater. Res.* , vol. 2, No. 3, May/Jun. 1987, pp. 322–328.

Dadykin, et al, "A study of stable low–field electron emission from diamond–like films," *Diamond and Related Materials*, vol. 5, 1996, pp. 771–774.

Evtukh, "Parameters of the tip arrays covered by low work function layers," *J. Vac. Sci. Technol. B,* vol. 14, No. 3, May/Jun. 1996, pp. 2130–2134.

Liu, et al, "Modification of Si field emitter surfaces by chemical conversion to SiC," *J. Vac. Sci. Technol. B*, vol. 12, No. 2, Mar./Apr. 1994, pp. 717–721.

Mousa, et al, "The effect of hydrogen and acetylene processing on microfabricated field emitter arrays," *Applied Surface Science*, vol. 67, 1993, pp. 218–221.

Myers, "Characterization of amorphous carbon coated silicon field emitters," *J. Vac. Sci. Technol. B*, vol. 14, No. 3, May/Jun. 1996, pp. 2024–2029.

*Primary Examiner*—Nimeshkumar D. Patel
*Assistant Examiner*—Todd Reed Hopper
*Attorney, Agent, or Firm*—Skjerven, Morrill MacPherson, Franklin & Friel LLP; Ronald J. Meetin

[57] ABSTRACT

Multiple procedures are presented for removing contaminant material (12) from electron-emissive elements (10) of an electron-emitting device (30). One procedure involves converting the contaminant material into gaseous products (14), typically by operating the electron-emissive elements, that move away from the electron-emissive elements. Another procedure entails converting the contaminant material into further material (16) and removing the further material. An additional procedure involves forming surface coatings (18 or 20) over the electron-emissive elements. The contaminant material is then removed directly from the surface coatings or by removing at least part of each surface coating.

60 Claims, 4 Drawing Sheets

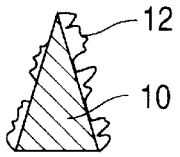
Fig. 5a
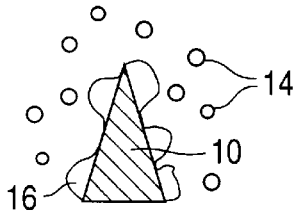
Fig. 5b
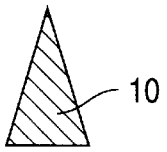
Fig. 5c
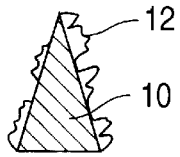
Fig. 6a
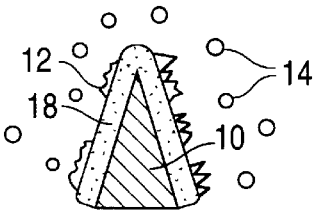
Fig. 6b
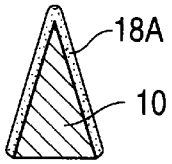
Fig. 6c
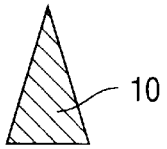
Fig. 6d
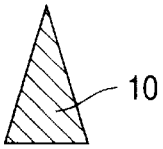
Fig. 7a
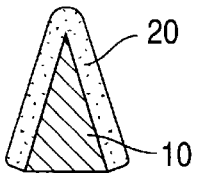
Fig. 7b
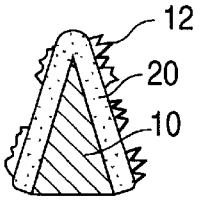
Fig. 7c
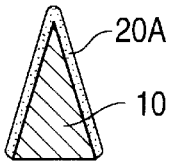
Fig. 7d1
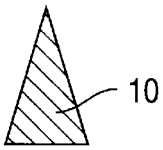
Fig. 7e1

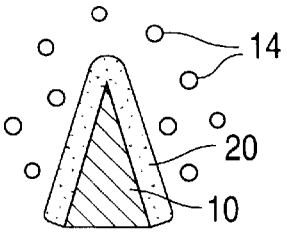
Fig. 7d2
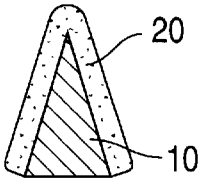
Fig. 7e2
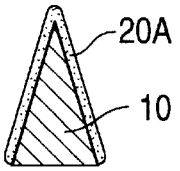
Fig. 7f2
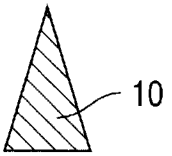
Fig. 7g2
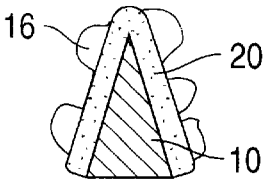
Fig. 7d3
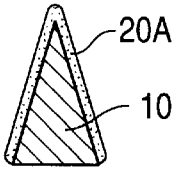
Fig. 7e3
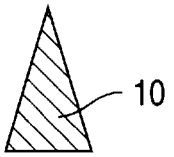
Fig. 7f3
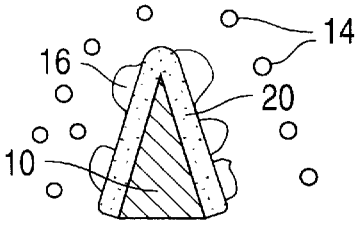
Fig. 7d4
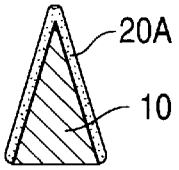
Fig. 7e4
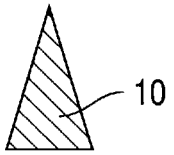
Fig. 7f4

CLEANING OF ELECTRON-EMISSIVE ELEMENTS

FIELD OF USE

This invention relates to the fabrication of electron-emitting devices suitable for use in flat-panel displays of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area. The emitted electrons are directed towards light-emissive elements distributed over a corresponding area in the light-emitting device. Upon being struck by the electrons, the light-emissive elements emit light that produces an image on the viewing surface of the display.

It is generally desirable that the electron-emissive elements be clean during display operation. Contaminants that build up on the surfaces of the electron-emissive elements, especially during display fabrication, act to increase the height and/or width of the electron tunneling barriers. This leads to higher operating voltages for the display. Also, contamination of the electron-emissive surfaces produces emission non-uniformity and leads to emission instability. Degraded display performance, even display failure, is commonly the result.

Liu et al, "Modification of Si field emitter surfaces by chemical conversion to SiC," *J. Vac. Sci. Tech. B,* March/April 1994, pages 717–721, describes various cleaning procedures applied to silicon electron-emissive elements. As Liu et al points out, electron-emissive elements made of pure silicon are especially reactive chemically. Liu et al starts out with oxide-sharpened silicon whiskers. Some of the silicon whiskers are further sharpened by dry oxidation at 950° C. followed by a hydrofluoric acid etch to remove the oxide coatings.

Prior to performing certain fabrication steps on the silicon whiskers, Liu et al cleans the whiskers at 950° C. in a vacuum to remove oxides and other contaminants. Liu et al also mentions that field evaporation or inert gas sputtering can be employed to clean silicon whiskers. Myers et al, "Characterization of amorphous carbon coated silicon field emitters," *J. Vac. Sci. Tech. B,* May/June 1996, pages 2024–2029, cleans silicon whiskers in aqua regia.

Other materials besides silicon are attractive for electron-emissive elements. One example is molybdenum. Mousa et al, "The effect of hydrogen and acetylene processing on microfabricated field emitter arrays," *Appl. Surf. Sci.,* 1993, pages 218–221, describes subjecting conical molybdenum electron-emissive elements to a hydrogen plasma. Mousa et al reports that the work function is reduced for molybdenum-emitter tips subjected to the hydrogen plasma. It is desirable to have techniques for cleaning (or conditioning) non-silicon electron-emissive elements, especially electron-emissive elements formed with metals such as molybdenum, in order to improve emission performance.

GENERAL DISCLOSURE OF THE INVENTION

The present invention furnishes such techniques. More particularly, the present invention provides techniques for cleaning electron-emissive elements, especially largely metallic emitters, of an electron-emitting device suitable for use in a larger product such as a flat-panel display.

In one aspect of the invention, contaminant material that overlies electron-emissive elements of an electron-emitting device is converted into gaseous products that move away from the electron-emissive elements. This is accomplished by a procedure in which selected gas-phase material is introduced into a chamber of a product, such as a partially finished flat-panel display, that contains an electron-emitting device. The gas introduction step is performed in such a way that the selected gas-phase material comes substantially into contact with the contaminant material. The gas-phase material normally interacts with the cortaminant material to form the gaseous products. In particular, the contaminant material is typically converted into the gaseous products by operating the electron-emissive elements. Subsequently, the gaseous products are removed from the chamber.

In another aspect of the invention, contaminant material, again overlying electron-emissive elements of an electron-emitting device, is converted into further material that likewise overlies the electron-emissive elements. The further material, which is typically more easily removable from the electron-emissive elements than the original contaminant material, is then removed from the electron-emissive elements. The removal of the further material can be accomplished by dissolving it in a liquid or subjecting it to a plasma. Instead of going through the intermediate conversion to further material, part of the original contaminant material can also be converted directly to gaseous products that move away from the electron-emissive elements.

Surface coatings, which are formed along electron-emissive elements of an electron-emitting device, are utilized in removing contaminant material from the electron-emissive elements in further aspects of the invention. Part of the material of the electron-emissive elements is typically caused to react with additional material to create the surface coatings. For example, the surface coatings can be formed as oxide of the material of the electron-emissive elements. The oxide formation can be achieved with an oxygen plasma or with a combination of diatomic oxygen and actinic radiation which converts the diatomic oxygen into monatomic oxygen and/or ozone that readily react with material of the electron-emissive elements.

Removal of the contaminant material can be handled in various ways when surface coatings are provided along the electron-emissive elements. In one procedure, contaminant material previously situated over the electron-emissive elements is removed during formation of the surface coatings. This can be accomplished by converting the contaminant material into gaseous products that move away from the electron-emissive elements as the surface coatings are created.

In another procedure, the surface coatings are formed below contaminant material that overlies the electron-emissive elements. The contaminant material is subsequently removed. The removal can, for example, be performed by removing at least part of each surface coating. The overlying contaminant material is then lifted off.

In a further procedure, the electron-emissive elements can be largely clean when the surface coatings are formed. Contaminant material which subsequently accumulates over the electron-emissive elements is thereafter removed. In this way, the electron-emissive elements are protected before they become contaminated. Any one or more of the contaminant removal techniques described above can be employed to remove the contaminant material in this procedure.

In short, the invention furnishes a number of techniques for removing contaminant material from electron-emissive elements. Whichever of the present techniques is suited to the manufacture of a particular electron-emitting device can be chosen for use in fabricating the device. The invention thus provides a substantial advance.

BRIEF DESCRIPTION OF THE DRAWINGS

FIGS. 5*a*–5*c* are cross-sectional structural views representing steps in which the techniques of FIGS. 1*a*–1*c* and 2*a*–2*c* are combined for cleaning electron-emissive elements of an electron-emitting device according to the invention.

FIGS. 6*a*–6*d* are cross-sectional structural views representing steps in which the techniques of FIGS. 3*a*–3*d* and 4*a*–4*d* are combined for cleaning electron-emissive elements of an electron-emitting device according to the invention.

FIGS. 7*a*–7*c* are cross-sectional structural views representing steps in a partial technique for cleaning electron-emissive elements of an electron-emitting device according to the invention.

FIGS. 7*d*1 and 7*e*1 are cross-sectional structural views representing one set of steps for finishing the cleaning technique of FIGS. 7*a*–7*c*.

FIGS. 7*d*2–7*g*2 are cross-sectional structural views representing another set of steps for finishing the cleaning technique of FIGS. 7*a*–7*c*.

FIGS. 7*d*3–7*f*3 are cross-sectional structural views representing a further set of steps for finishing the cleaning technique of FIGS. 7*a*–7*c*.

FIGS. 7*d*4–7*f*4 are cross-sectional structural views representing yet another set of steps for finishing the cleaning technique of FIGS. 7*a*–7*c*.

Like reference symbols are employed in the drawings and in the description of the preferred embodiments to represent the same, or very similar, item or items.

DESCRIPTION OF THE PREFERRED EMBODIMENTS

Techniques are furnished in accordance with the invention for cleaning (or conditioning) electron-emissive elements of an electron-emitting device so as to improve device performance. The electron-emitting device is typically a field-emission cathode, or field emitter, suitable for exciting light-emissive elements of a light-emitting device situated opposite the field emitter. The combination of the field emitter and the light-emitting device forms a flat-panel CRT display such as a flat-panel CRT television or a flat-panel CRT video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers Go materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

Figure 1A:
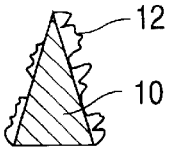
FIGS. 1*a*–1*c* are cross-sectional structural views representing steps in one technique for cleaning electron-emissive elements of an electron-emitting device according to the invention.
Figure 1B:
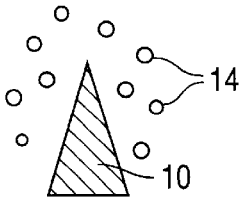
Figure 1C:
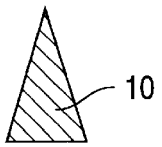

FIGS. 1*a*–1*c* (collectively "FIG. 1") illustrate a technique for cleaning conical electron-emissive elements 10 of a field emitter according to the invention's teachings. One electron-emissive element 10 is shown in FIG. 1. Other components of the field emitter, along with components of the light-emitting device, are depicted in FIG. 8 discussed below.

Figure 8:
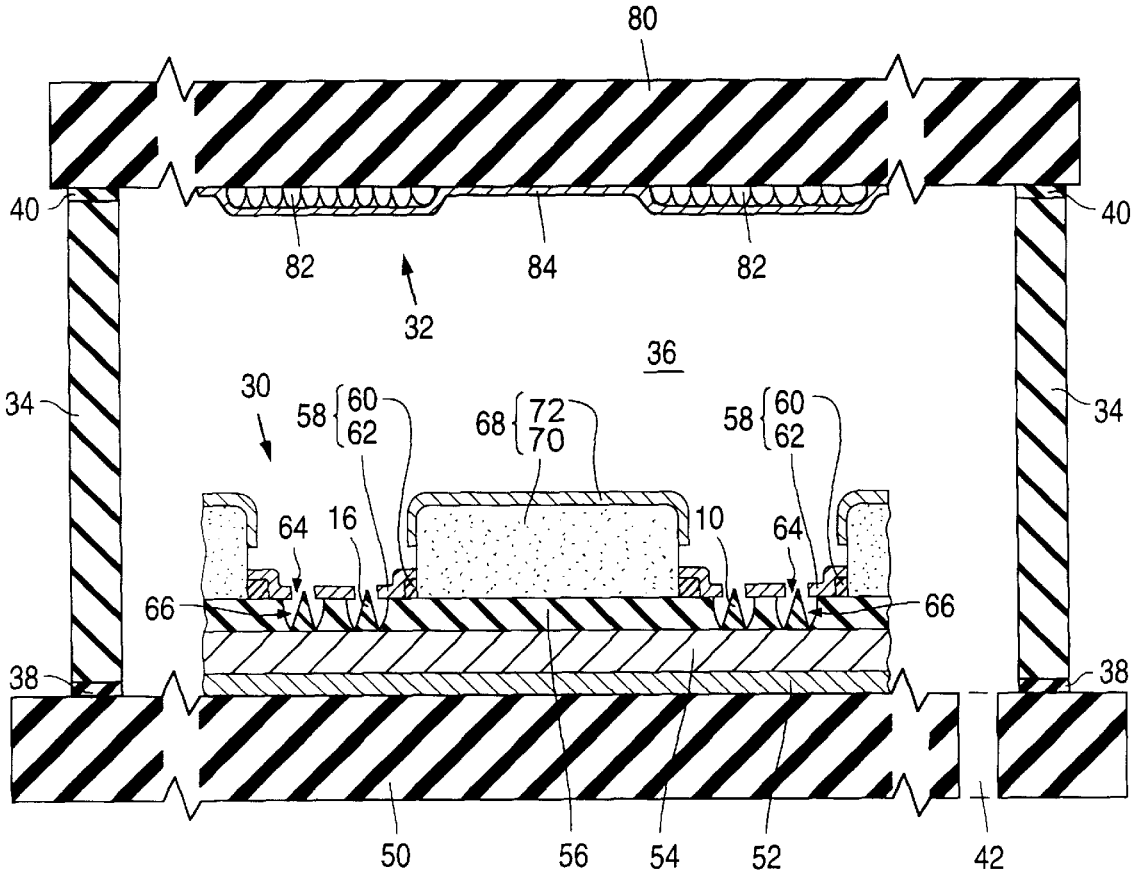
FIG. 8 is a cross-sectional structural view of a flat-panel CRT display that includes a gated field emitter having electron-emissive elements cleanable in accordance with the invention.

Referring to FIG. 1*a*, the base of conical electron-emissive element 10 contacts an electrically non-insulating region (shown in FIG. 8 but not shown here). Electrons are emitted largely from the tip of electron-emissive cone 10 during display operation. Cone 10 normally consists largely of metal, typically molybdenum. Other materials that can be employed to form cone 10 are (a) metals such as nickel, palladium, and platinum, (b) electrically conductive metal oxides such as ruthenium oxide, (c) metal carbides, and (d) metal silicides. While consisting largely of metal, cone 10 can have a thin coating that enhances the electron-emission characteristics. For example, cone 10 can be coated with carbon or carbon-containing material that reduces the work function so as to reduce the necessary operating voltages for the flat-panel CRT display.

Contaminant material 12 is situated at various locations on the conical outside surface of electron-emissive element 10. Contaminant 12 accumulates on cone 10 in various ways during the period subsequent to the formation of cone 10. Part of contaminant 12 typically accumulates on cone 10 during fabrication steps employed in manufacturing the flat-panel display after cone 10 is created. Contaminant 12 may consist of organic and/or inorganic material such as polymeric material, especially polymeric residues from photolithographic processing steps, and solid reaction byproducts of plasma (dry) or chemical (wet) etching steps, including metal nitrates, oxides, and carbonates.

In the process of FIG. 1, contaminant material 12 is removed from electron-emissive cone 10 by converting contaminant 12 into gaseous products 14 that move away from cone 10. See FIG. 1*b*. This contaminant-to-gas conversion is performed at the fabrication stage in which the field emitter and the light-emitting device have been joined together, typically through an outer wall, but final sealing has not yet taken place.

The field emitter, light-emitting device, and outer wall form a main chamber in which electron-emissive elements 10 covered with contaminant material 12 are situated along the inside of the chamber. FIG. 8, discussed further below, illustrates the main chamber (36) of the flat-panel CRT display. The chamber has an inlet/outlet port (42) through which gas can enter and leave the chamber.

Conversion of contaminant material 12 into gaseous products 14 is initiated by evacuating the main chamber through the inlet/outlet port—i.e., pumping the chamber down to a low pressure, normally less than $10^{-1}$ torr, typically $10^{-7}$ torr or lower. A selected gas such as hydrogen, helium, neon, argon, krypton, xenon, nitrogen, oxygen, fluorine, chlorine, bromine, iodine, chloromethane, dichloromethane, trichloromethane (chloroform), carbon tetrachloride, carbon tetrafluoride, fluoromethane, difluoromethane, an alkane varying from methane through octane, an alkene varying from ethene (ethylene) through octene, an alkyne varying from ethyne (acetylene) through octyne, an alkol varying from methanal through hexanal, a ketone varying from acetone through hexanone, an aldehyde varying from methanal through hexanal, formic acid, acetic acid, propionic acid, water, hydrogen peroxide, hydrazine, nitrous oxide, nitric oxide, nitrogen dioxide, carbon monoxide, carbon dioxide, ammonia, phosphine, arsine, stibine, hydrogen fluoride, hydrogen chloride, hydrogen bromide, hydrogen iodide, boron fluoride, diborane, nitrogen trifluoride, hydrogen sulfide, hydrogen selenide, hydrogen telluride, or sulfur dioxide, or a combination of two or more of these gases, is introduced through the port into the chamber.

The flat-panel display is then operated, causing electron-emissive cones 10 of the field emitter to emit electrons that move towards the light-emitting device. During operation of the display, part of the selected gas comes largely into contact with contaminant 12. The act of operating each cone 10 typically causes part of the selected gas to interact with contaminant 12 in such a way that contaminant 12 is converted to gaseous products 14. The interaction may involve chemical reaction.

Electron-emissive cone 10 in FIG. 1 can also be heated. Depending on the selected gas introduced into the main chamber, part or all of contaminant 12 may burn, thereby converting that contaminant material 12 to gaseous products 14. In this case, some residue (not shown) may be left on cone 10. Certain species, particularly certain oxide species, of contaminant 12 may volatize upon being heated.

The main chamber is then re-evacuated through the inlet/outlet port to remove gaseous products 14 from the chamber. In particular, the chamber is typically pumped down to a pressure of $10^{-7}$ torr or lower. FIG. 1*c* illustrates resulting cleaned electron-emissive cone 10, gaseous products 14 having been removed from the vicinity of cone 10. After the re-evacuation is completed, the port is permanently closed to seal the chamber and make it air tight. The process of FIG. 1 is complete.

An alternative technique, represented by FIG. 1 in certain applications, is to subject the structure of FIG. 1*a* to an oxygen plasma that converts contaminant material 12 to gaseous products 14. If substantially none of the material of electron-emissive cone 10 is oxidized during the oxygen plasma step, FIG. 1*b* represents the structure at the end of the plasma step. Should part of the material of cone 10 oxidize during the plasma step, this alternative technique is generally represented by the steps shown in FIGS. 3*a*–3*d* or 6*a*–6*d*, discussed below. In that case, an oxide etch, likewise discussed below, is performed to remove the oxide from the conical surface of cone 10.

Figure 2A:
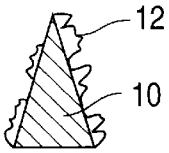
FIGS. 2*a*–2*c* are cross-sectional structural views representing steps in another technique for cleaning electron-emissive elements of an electron-emitting device according to the invention.
Figure 2B:
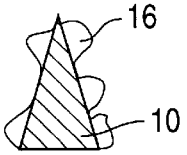
Figure 2C:
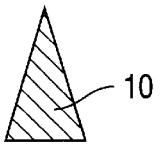

Another technique for cleaning metallic electron-emissive elements 10 of a field emitter according to the invention is illustrated in FIGS. 2*a*–2*c* (collectively "FIG. 2"). The starting point for the process of FIG. 2 is the structure of FIG. 1*a,* repeated here as FIG. 2*a*, in which contaminant material 12 overlies the conical outside surface of electron-emissive element 10. In the process of FIG. 2, at least part of contaminant 12 is known, or expected to be, of such a nature that it is difficult to directly remove that contaminant in a rapid or/and efficient manner without damaging cone 10 or removing an excessive amount of cone 10.

The first step in the process of FIG. 2 is to convert contaminant material 12 into further contaminant material 16 that can be removed rapidly, efficiently, and selectively from electron-emissive cone 10 without damaging cone 10. See FIG. 2*b*. This conversion step can be implemented by causing selected additional material to react with original contaminant 12 to form further contaminant 16. The additional material can be in gas-phase and/or liquid-phase form.

Alternatively, the conversion of original contaminant 12 to further contaminant 16 can be performed by subjecting contaminant 12 to suitable actinic radiation that causes contaminant 12 to change chemical composition. Ultraviolet ("UV") light is appropriate actinic radiation for certain types of contaminant 12. In addition, further contaminant 16 can be created from original contaminant 12 by applying actinic radiation to additional material and causing contaminant 12 to react with the additional material. The two actinic radiation steps can be performed simultaneously or one after the other.

Further contaminant 16 is then removed from electron-emissive cone 10. FIG. 2*c*, which repeats FIG. 1*c,* depicts the cleaned version of cone 10.

The removal of further contaminant 16 can be accomplished in various ways. For example, contaminant 16 can be dissolved in liquid etchant which does not significantly attack electron-emissive cone 10. Part of contaminant 16 can be converted into particles that become suspended in the liquid etchant. A plasma, which likewise does not significantly attack cone 10, can be employed to remove contaminant 16. Depending on its constituency, contaminant 16 can also be removed by utilizing suitable actinic radiation that converts contaminant 16 into gaseous products that move away from cone 10. Two or more of these techniques can be employed to remove contaminant 16 from cone 10.

Figure 3A:
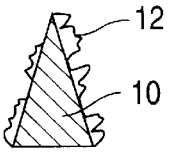
FIGS. 3*a*–3*d* are cross-sectional structural views representing steps in a further technique for cleaning electron-emissive elements of an electron-emitting device according to the invention.
Figure 3B:
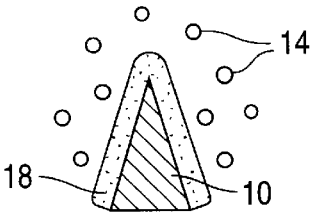

FIGS. 3*a*–3*d* (collectively "FIG. 3") depict a third technique for cleaning metallic electron-emissive elements 10 of a field emitter according to the the structure of FIG. 1*a,* now repeated as FIG. 3*a*. Surface coatings 18 are formed along the conical surfaces of electron-emissive elements 10 as overlying contaminant material 12 is converted into gaseous products 14 that move away from cone 10. FIG. 3*b* depicts the structure at this point.

Surface coating 18 for electron-emissive cone 10 in FIG. 3*b* can be created in various ways. Typically, part of the material along the conical surface of cone 10 is reacted with additional material to form coating 18. The reaction can be enhanced by simultaneously subjecting cone 10 to actinic radiation, again typically UV light. The reaction may also be enhanced by heating cone 10 or subjecting it to infrared radiation.

Surface coating 18 is typically created by oxidizing a small thickness of the emitter material along the conical surface of cone 10. For example, cone 10 and contaminant material 12 can be subjected to an oxygen plasma that creates coating 18 and simultaneously converts at least part of contaminant 12 into gaseous products 14. Instead of using an oxygen plasma, cone 10 and contaminant 12 can be subjected simultaneously to diatomic (gas-phase) oxygen and actinic radiation, typically UV light, that causes part of the diatomic oxygen to form monatomic oxygen and ozone. Although diatomic oxygen is not highly reactive at low temperature, monatomic oxygen and ozone are both highly reactive at low temperature and react with the emitter material along the conical surface of cone 10 to form coating 18. The UV/oxygen treatment, normally done at no more than 50° C., typically causes at least part of contaminant 12 to be converted into gaseous products 14.

Various phenomena can be used to produce gaseous products 14 that move away from electron-emissive cone 10 as surface coating 18 is formed. For example, as in each of the foregoing procedures where coating 10 is created as an oxide of the emitter material, gaseous products 14 can be formed as an attendant effect of the reaction involved in creating coating 18. If actinic radiation, such as UV light, is not employed to promote the reaction, actinic radiation can be separately utilized to convert part or all of contaminant 12 to the gas phase. Rapid heating (i.e., rapid thermal processing) can be used to vaporize contaminant 12 if it is volatile at relatively high temperature.

Figure 3C:
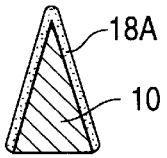
Figure 3D:
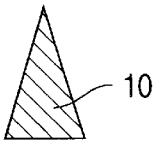

Surface coating 18 may, or may not, impair the emission performance of electron-emissive cone 10. If the emission performance is impaired, coating 18 is at least partially removed. FIG. 3*c* illustrates a situation in which part of coating 18 is removed. The remaining portion of coating 18 is indicated as item 18A. Coating 18 can be fully removed as shown in FIG. 3*d*, which repeats FIG. 1*c*.

The partial or total removal of surface coating 18 can be accomplished in various ways. When coating 18 is formed as an oxide of the emitter material, part or all of coating 18 can be removed with a suitable plasma, typically a hydrogen plasma. Alternatively, coating 18 can be partially or totally dissolved in a liquid chemical etchant. This typically entails immersing cone 10 in the liquid etchant. When cone 10 and surface coating 18 respectively consist of molybdenum and molybdenum oxide, a typical liquid etchant for partially or totally removing coating 18 is an aqueous solution of tris-(hydromethyl)amino methane at approximately 60° C.

Alternatively, cone 10 and coating 18 can undergo an operation in which the additional material, such as oxygen, utilized to form coating 18 is removed from coating 18, thereby converting coating 18 back into the emitter material of cone 10. This conversion is simply a reduction when coating 18 is an oxide of the emitter material. FIG. 3*d* also represents the final structure of cone 10 for this alternative.

Figure 4A:
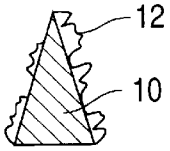
FIGS. 4*a*–4*d* are cross-sectional structural views representing steps in yet another technique for cleaning electron-emissive elements of an electron-emitting device according to the invention.
Figure 4B:
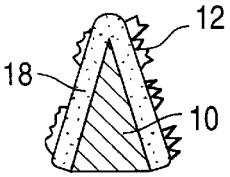

A fourth technique for cleaning metallic electron-emissive elements 10 of a field emitter in accordance with the invention is depicted in FIGS. 4*a*–4*d* (collectively "FIG. 4"). The structure of FIG. 1*a*, repeated here as FIG. 4*a*, is the starting point for the process of FIG. 4. Similar to the process of FIG. 3, surface coating 18 is formed along the conical surface of electron-emissive element 10. Likewise, coating 18 can be formed in any of the ways described above for the process of FIG. 3.

The techniques of FIGS. 3 and 4 differ in what happens to contaminant material 12. Instead of being converted to gas, contaminant 12 in the process of FIG. 4 continues to overlie cone 10 as surface coating 18 is formed below contaminant 12. See FIG. 4*b*. Although not indicated in FIG. 4*b*, part or all of contaminant 12 may be converted to a different chemical form, similar to further contaminate 16 in the process of FIG. 2, during the formation of coating 18.

Contaminant material 12 (including any portion of changed chemical form) is subsequently removed. The removal of contaminant 12 is typically accomplished by removing at least part of surface coating 18. Contaminant 12 is then lifted off.

The partial or total removal of surface coating 18 can be performed in any of the ways described above for the process of FIG. 3. When a plasma, such as a hydrogen plasma, is utilized to partially or totally remove coating 18, various mechanisms may come into action for transporting contaminant material 12 away from the vicinity of cone 10. For example, contaminant 12 can be swept away in the flow of gas and plasma components through the plasma chamber. Alternatively or additionally, contaminant 12 can become suspended in the plasma cue to the accumulation of electrostatic charge.

When coating 18 is partially or totally removed with a liquid chemical etchant, contaminant material 12 normally dissolves and/or becomes suspended in the etchant. Stirring of the etchant may be performed to move particles of contaminant 12 away from cone 10 and prevent those particles from redepositing on cone 10. This can, for instance, be implemented by ultrasonic agitation of the etchant. Filtration can also be employed to inhibit redeposition of contaminant 12 on cone 10.

Figure 4C:
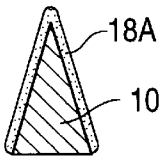
Figure 4D:
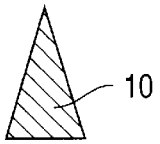

FIG. 4*c* illustrates the situation in which the lift off of contaminant material 12 is achieved by removing part of surface coating 18. Item 18A is the remainder of surface coating 18. In this example, the presence of reduced-thickness surface coating 18A normally does not significantly degrade the emission performance of cone 10, and may indeed enhance the emission performance. FIG. 4*d* illustrates the condition in which the removal of coating 18 is continued until it is totally removed.

The techniques of FIGS. 1–4 can be combined in various ways. FIGS. 5*a*–5*c* (collectively "FIG. 5") and 6*a*–6*d* (collectively "FIG. 6") present examples of two such combinations.

FIG. 5 Illustrates how a combination of the techniques of FIGS. 1 and 2 is employed for cleaning metallic electron-emissive cones 10 of a field emitter in accordance with the invention. In the process of FIG. 5, the starting point is again the structure of FIG. 1*a*, now repeated as FIG. 5*a*. Part of contaminant material 12 is converted into gaseous products 14 that move away from cone 10 as indicated in FIG. 5*b*. The remainder of contaminant 12 is converted into further contaminant material 16 which overlies cone 10 but is more readily removable from cone 10 than original contaminant 12. The conversion of contaminant 12 into gaseous products 14 and further contaminant 16 can be done in one operation or in separate operations.

Further contaminant 16 is subsequently removed to produce the cleaned structure of FIG. 5*c*. Any of the procedures described above for the techniques of FIG. 1 and 2 can be utilized in the various conversion and removal steps in the technique of FIG. 5.

FIG. 6 illustrates how the techniques of FIGS. 3 and 4 are combined in accordance with the invention to clean metallic electron-emissive cones 10 of a field emitter. The process of FIG. 6 begins with the structure of FIG. 1*a*, here repeated as FIG. 6*a*. Surface coating 18 is formed along the conical surface of cone 10 below portions of contaminant material 12 as shown in FIG. 6*b*. Similar to the process FIG. 4, part of all of these portions of contaminant 12 may be converted to different chemical form during the creation of coating 18. The remainder of contaminant 12 is converted into gaseous products 14 that move away from cone 10. The formation of coating 18 and the partial conversion of part of contaminant 12 into gaseous products 14 can be done in one operation or in separate operations.

The portions of contaminant material 12 overlying surface coating 18 are subsequently removed. Any of the procedures described above for the techniques of FIGS. 3 and 4 can be utilized in the various formation, conversion, and removal steps in the technique of FIG. 6. FIG. 6*c* illustrates the resultant structure when part of coating 18 is removed, item 18A again indicating t he remainder of coating 18. FIG. 6*d* illustrates the structure when coating 18 is fully removed.

FIGS. 7*a*–7*c*, 7*d*1, 7*e*1, 7*d*2–7*g*2, 7*d*3–7*f*3, and 7*d*4–7*f*4 (collectively "FIG. 7") illustrate a general technique, including a number of processing branches, for treating metallic electron-emissive elements 10 of a field emitter in accordance with the invention so as to keep electron-emissive elements 10 clean. The process of FIG. 7 begins with elements 10 in a largely clean condition. See FIG. 7*a*. For this purpose, the structure of FIG. 7*a* represents the situation in which electron-emissive cone 10 has just been cleaned, for example, according to any of the techniques of FIGS. 1–6 or in which the fabrication of cone 10 has recently been completed and cone 10 is under vacuum and can be accessed through an inlet/outlet port.

A surface coating 20 is formed along the conical outside surface of electron-emissive element 10 as depicted in FIG. 7*b*. Surface coating 20 can be created according to any of the procedures used to form surface coating 18 in the process of FIG. 3. For example, coating 20 can be formed by reacting a small thickness of the material of cone 10 with additional material, typically a gas such as oxygen.

Contaminant material 12 subsequently accumulates over surface coating 20 as shown in FIG. 7*c*. Various procedures can be employed to remove contaminant 12. FIGS. 7*d*1, 7*e*1, 7*d*2–7*g*2, 7*d*3–7*f*3, and 7*d*4–7*f*4 present four such procedures, each group of figures whose figure numbers end with the same numerical value representing a different one of the procedures.

Referring to FIGS. 7*d*1 and 7*e*1, part or all of surface coating 20 can be removed to lift off contaminant material 12. FIG. 7*d*1 illustrates the situation in which part of coating 20 is removed. Item 20A is the remainder of coating 20. FIG. 7*e*1 illustrates the situation in which all of coating 20 is removed.

In FIGS. 7*d*2–7*g*2, contaminant 12 is converted into gaseous products 14 that move away from cone 10. See FIG. 7*d*2. Coating 20 may improve the emission performance of cone 10 or, at the minimum, not significantly degrade the emission performance. If so, coating 20 can be left in place as represented in FIG. 7*e*2. Alternatively, part of coating 20 can be removed as shown in FIG. 7*f*2 in which item 20A is again the remainder of coating 20. Finally, FIG. 7*g*2 illustrates the case in which coating 20 is totally removed.

Referring to FIGS. 7*d*3–7*f*3, contaminant material 12 is converted into further contaminant material 16 as shown in FIG. 7*d*3. Further contaminant 16 may be more easily removed from coating 20 than original contaminant 12. If so, further contaminant 16 can be separately removed without significantly affecting coating 20. Alternatively, part or all of coating 20 can be removed to lift off contaminant 16. FIGS. 7*e*3 and 7*f*3 respectively represent the cases in which coating 20 is partially and fully removed.

FIGS. 7*d*4–7*f*4 illustrate how the procedure of FIGS. 7*d*3–7*f*3 is combined with that of FIGS. 7*d*2–7*g*2. Part of contaminant 12 is converted into further contaminant 16 while the remainder of original contaminant 12 is converted into gaseous products 14 that move away from cone 10. See FIG. 7*d*4. Further contaminant 16, which may be more easily removed from surface coating 20 than original contaminant 12, is subsequently removed. FIG. 7*e*4 illustrates the situation in which at least part of coating 20 is removed to lift off further contaminant 16. The removal of all of coating 20 is represented by the structure of FIG. 7*f*4.

FIG. 8 illustrates an example of a flat-panel CRT display having a field emitter 30 which employs electron-emissive cones 10 that are cleaned according to the invention. In addition to field emitter 30, the components of the flat-panel display include a light-emitting device 32 and an annular outer wall 34. Field emitter 30 and light emitting device 32 are joined together through outer wall 34, typically glass, to form a chamber 36. Item 38 in FIG. 8 indicates sealing material, typically glass frit, by which outer wall 34 is joined to field emitter 30. Item 40 similarly indicates sealing material, again typically glass frit, by which wall 34 is joined to light-emitting device 32.

The flat-panel display has an inlet/outlet port 42 through which gas can be introduced into, and removed from, chamber 36. Inlet/outlet port 42 is shown as extending through a peripheral portion of field emitter 30 in FIG. 8. FIG. 8 depicts port 42 in its open condition. In finally sealing the flat-panel display, the pressure in chamber 36 is reduced to $10^{-7}$ torr or less, and port 42 is permanently closed to make chamber 36 air tight.

Field emitter 30 is created from a thin flat electrically insulating baseplate 50 typically consisting of glass. A lower electrically non-insulating emitter region lies on top of baseplate 50. The lower emitter region typically consists of (a) a group of laterally separated generally parallel emitter electrodes 52 situated on baseplate 50 and (b) an electrically resistive layer 54. Emitter electrodes 52, one of which is shown in FIG. 8, typically consist of metal such as aluminum or nickel. Resistive layer 54 typically consists of cermet and/or a silicon-carbon-nitrogen compound.

A dielectric layer 56, typically consisting of silicon oxide or silicon nitride, is situated on resistive layer 54 and may contact baseplate 50 depending on the shape of layer 54. A group of laterally separated generally parallel control electrodes 58 extend across dielectric layer 56 generally perpendicular to emitter electrodes 50. Two control electrodes 58 are depicted in FIG. 8. Each control electrode 58 consists of (a) a main control portion 60 that extends the length of that control electrode 58 and (b) one or more thinner adjoining gate portions 62. Main control portions 60 and gate portions 62 both typically consist of chromium.

A multiplicity of composite openings extend through gate portions 62 and dielectric layer 56 down to resistive layer 54 of the lower non-insulating region. Each composite opening consists of (a) a gate opening 64 extending through one of gate portions 62 and (b) a dielectric opening 66 extending through dielectric layer 56. Each composite opening 64/66 contains one electron-emissive cone 10. Accordingly, cones 10 are situated along the inside of chamber 36. Cones 10 are arranged in a two-dimensional array of laterally separated sets of multiple cones 10.

Field emitter 30 also contains an electron focusing system 68 arranged generally in a waffle-like pattern. Focusing system 68 consists of a base focusing structure 70 and an adjoining focus coating 72. Base focusing structure 70 is typically formed with electrically resistive material or electrically insulating material. Focus coating 72 is formed with electrically non-insulating material, typically metal. Focusing system 68 controls the trajectories of electrons emitted by electron-emissive cones 10 so that they strike intended portions of light-emitting device 32. The cleaning techniques of the invention overcome contamination of cones 10 that occurs during the formation of focusing system 68.

Light-emitting device 32 is created from a thin flat transparent electrically insulating faceplate 80 typically glass, located across from baseplate 50. Light-emitting phosphor regions 82 are situated on the interior surface of faceplate 80 directly across from corresponding sets of electron-emissive elements 10. A thin light-reflective layer 84, typically aluminum, overlies phosphor regions 82 along the interior surface of faceplate 80. Electrons emitted by electron-emissive elements 10 pass through light-reflective layer 84 and cause phosphor regions 82 to emit light that produces an image visible on the exterior surface of faceplate 80.

The flat-panel CRT display typically includes other components not shown in FIG. 8. For example, a getter is provided to remove contaminant gases that enter chamber 36 after final display sealing, typically as a result of operating the display or by penetration of the seal. A black matrix situated along the interior surface of faceplate 80 typically surrounds each phosphor region 82 to laterally separate it from other phosphor regions 82. Spacer walls are utilized to maintain a relatively constant spacing between baseplate 50 and faceplate 80.

When incorporated into a flat-panel CRT display of the type illustrated in FIG. 8, a field emitter manufactured according to the invention operates in the following way. Light-reflective layer 84 serves as an anode for the field-emission cathode. The anode is maintained at high positive potential relative to the electrodes 52 and 58.

When a suitable potential is applied between (a) a selected one of emitter electrodes 52 and (b) a selected one of control electrodes 58, the so-selected gate portion 62 extracts electrons from electron-emissive elements 10 at the intersection of the two selected electrodes and controls the magnitude of the resulting electron current. Desired levels of electron emission typically occur when the applied gate-to-cathode parallel-plate electric field reaches 20–100 volts/mm or less at a current density of 0.1 $mA/cm^2$ as measured at phosphor-coated faceplate 80 when phosphor regions 82 are high-voltage phosphors. Upon being hit by the extracted electrons, phosphor regions 82 emit light.

While the invention has been described with reference to particular embodiments, this description is solely for the purpose of illustration and is not to be construed as limiting the scope of the invention claimed below. For instance, electron-emissive elements 10 can have shapes other than cones. One example is filaments. Another example is cones on pedestals.

Electron-emissive elements 10 can be utilized in electron-emitting devices that operate according to mechanisms such as thermionic emission and photoemission. Electron-emitting devices that contain electron-emissive elements 10 cleaned according to the invention can be employed in flat-panel products other than flat-panel CRT displays. Examples include products utilized in electron spectroscopy, in generating X rays or microwaves from electron beams, and in evaporating materials by electron-beam heating. Various modifications and applications may thus be made by those skilled in the art without departing from the true scope and spirit of the invention as defined in the appended claims.

We claim:

1. A method comprising the steps of:

converting contaminant material overlying electron-emissive elements of an electron-emitting device into gaseous products that move away from the electron-emissive elements by a procedure that entails introducing selected gas-phase material into a chamber of a product containing the electron-emitting device such that the selected gas-phase material comes substantially into contact with the contaminant material; and largely removing the gaseous products from the chamber.

2. A method as in claim 1 wherein the selected gas-phase material interacts with the contaminant material to form the gaseous products.

3. A method as in claim 1 further including, before the converting step, the step of largely evacuating the chamber.

4. A method as in claim 1 wherein the selected gas-phase material comprises at least one of hydrogen, helium, neon, argon, krypton, xenon, nitrogen, oxygen, fluorine, chlorine, bromine, iodine, chloromethane, dichloromethane, trichloromethane, carbon tetrachloride, carbon tetrafluoride, fluoromethane, difluoromethane, an alkane varying from methane through octane, an alkene varying from ethene through octene, an alkyne varying from ethyne through octyne, an alkol varying from methanal through hexanal, a ketone varying from acetone through hexanone, an aldehyde varying from methanal through hexanal, formic acid, acetic acid, propionic acid, water, hydrogen peroxide, hydrazine, nitrous oxide, nitric oxide, nitrogen dioxide, carbon monoxide, carbon dioxide, ammonia, phosphine, arsine, stibine, hydrogen fluoride, hydrogen chloride, hydrogen bromide, hydrogen iodide, boron fluoride, diborane, nitrogen trifluoride, hydrogen sulfide, hydrogen selenide, hydrogen telluride, and sulfur dioxide.

5. A method as in claim 1 wherein the electron-emitting device comprises:

a group of laterally separated emitter electrodes;

a dielectric layer overlying the emitter electrode; and a group of control electrodes overlying the dielectric layer and crossing over the emitter electrodes, the electron-emissive elements situated above the emitter electrodes in composite openings extending through the control electrodes and the dielectric layer.

6. A method as in claim 1 wherein the product is a flat-panel display.

7. A method as in claim 1 wherein the converting step includes operating the electron-emissive elements.

8. A method as in claim 1 wherein the electron-emissive elements are largely metallic.

9. A method comprising the steps of:

converting contaminant material overlying electron-emissive elements of an electron-emitting device into further material overlying the electron-emissive elements; and removing the further material from the electron-emissive elements.

10. A method as in claim 9 wherein the converting step comprises reacting at least part of the contaminant material with additional material to produce the further material.

11. A method as in claim 9 wherein the converting step comprises subjecting the contaminant material to actinic radiation.

12. A method as in claim 11 wherein the converting step further includes reacting at least part of the contaminant material with additional material to produce at least part of the further material.

13. A method as in claim 9 wherein the removing step comprises dissolving the further material in a liquid and/or causing particles of the further material to become suspended in the liquid.

14. A method as in claim 9 wherein the removing step comprises subjecting the further material to a plasma.

15. A method as in claim 9 wherein the converting and removing steps entail converting contaminant material overlying the electron-emissive elements into gaseous products that move away from the electron-emissive elements.

16. A method as in claim 15 wherein the converting and removing steps further entail operating the electron-emissive elements.

17. A method as in claim 16 wherein the removing step includes removing the gaseous products from a chamber of a product containing the electron-emitting device.

18. A method as in claim 9 wherein the electron-emissive elements are largely metallic.

19. A method comprising the following steps for removing contaminant material that overlies electron-emissive elements of an electron-emitting device:

forming surface coatings along the electron-emissive elements; and largely simultaneously removing the contaminant material from the electron-emissive elements.

20. A method as in claim 19 wherein the removing step comprises converting at least part of the contaminant material into gaseous products that move away from the electron-emissive elements.

21. A method as in claim 20 wherein the removing step entails operating the electron-emissive elements.

22. A method as in claim 21 wherein the removing step includes removing the gaseous products from a chamber of a product containing the electron-emitting device.

23. A method as in claim 19 wherein the forming step comprises reacting additional material with material of the electron-emissive elements to form the surface coatings.

24. A method as in claim 23 wherein the forming step further includes subjecting the contaminant material to actinic radiation.

25. A method as in claim 23 further including the step of removing at least part of the additional material from the surface coatings so as to convert at least part of the surface coatings back into original material of the electron-emissive elements.

26. A method as in claim 19 wherein the forming step comprises oxidizing material of the electron-emissive elements to form the surface coatings as oxide of that material.

27. A method as in claim 26 further including the step of reducing at least part of the oxide.

28. A method as in claim 19 wherein the removing step entails subjecting the contaminant material to actinic radiation.

29. A method as in claim 19 further including the step of removing at least part of each surface coating.

30. A method as in claim 19 wherein the electron-emissive elements are largely metallic.

31. A method comprising the following steps for removing contaminant material that overlies electron-emissive elements of an electron-emitting device:

forming surface coatings along the electron-emissive elements below the contaminant material; and subsequently removing the contaminant material.

32. A method as in claim 31 wherein the removing step entails removing at least part of each surface coating to remove the overlying contaminant material.

33. A method as in claim 31 wherein the removing step entails removing largely all of each surface coating to remove the overlying contaminant material.

34. A method as in claim 31 wherein the forming step comprises reacting additional material with material of the electron-emissive elements to form the surface coatings.

35. A method as in claim 31 wherein the forming step comprises oxidizing material of the electron-emissive elements to form the surface coatings largely as oxide of that material.

36. A method as in claim 35 wherein the forming step comprises subjecting the electron-emissive elements to an oxygen-containing plasma.

37. A method as in claim 35 wherein the forming step comprises subjecting the electron-emissive elements to monatomic oxygen and/or ozone.

38. A method as in claim 37 wherein the forming step includes subjecting diatomic oxygen to actinic radiation to produce the monatomic oxygen and/or ozone.

39. A method as in claim 35 wherein the removing step comprises dissolving at least part of each oxide surface coating in a liquid.

40. A method as in claim 35 wherein the removing step comprising subjecting at least part of each oxide surface coating to a plasma.

41. A method as in claim 31 further including the step of converting contaminant material overlying the electron-emissive elements into gaseous products that move away from the electron-emissive elements.

42. A method as in claim 41 wherein the forming step comprises subjecting the electron-emissive elements to actinic radiation.

43. A method as in claim 42 wherein the removing step entails removing at least part of each surface coating so as to remove the overlying contaminant material.

44. A method as in claim 31 wherein the electron-emissive elements are largely metallic.

45. A method comprising the steps of:

forming surface coatings over electron-emissive elements of an electron-emitting device; and removing contaminant material that subsequently accumulates over the surface coatings.

46. A method as in claim 45 wherein the removing step comprises removing at least part of each surface coating so as to remove the overlying contaminant material.

47. A method as in claim 45 wherein the removing step comprises converting contaminant material that accumulates over the surface coatings into gaseous products that move away from the surface coatings.

48. A method as in claim 47 further including the step of removing at least part of each surface coating.

49. A method as in claim 45 wherein the removing step comprises:

converting contaminant material that accumulates over the electron-emissive elements into further material; and removing the further material.

50. A method as in claim 49 further including the step of converting contaminant material that accumulates over the electron-emissive elements into gaseous products that move away from the electron-emissive element.

51. A method comprising the steps of:

subjecting electron-emissive elements of an electron-emitting device to an oxygen-containing plasma for removing contaminant material overlying the electron-emissive elements; and subsequently subjecting the electron-emissive elements to etchant capable of removing oxide material from the electron-emissive elements.

52. A method as in claim 51 wherein the second subjecting step is at least partially performed with a liquid chemical etchant.

53. A method as in claim 51 wherein the second subjecting step is at least partially performed with a plasma.

54. A method as in claim 51 wherein the plasma employed in the second subjecting step is a hydrogen-containing plasma.

55. A method as in claim 51 wherein the electron-emissive elements are largely metallic.

56. A method as in claim 51 wherein the electron-emissive elements consist primarily of at least one of molybdenum, nickel, palladium, platinum, electrically conductive metal oxide, metal carbide, and metal silicide.

57. A method comprising the following steps for removing contaminant material that overlies electron-emissive elements of an electron-emitting device:

subjecting the electron-emissive elements to at least one of monatomic oxygen and ozone in order to form surface coatings of oxide of material of the electron-emissive elements below the contaminant material along the electron-emissive elements; and subsequently removing at least part of each surface coating.

58. A method as in claim 57 wherein the subjecting step entails subjecting the electron-emissive elements to diatomic oxygen and actinic radiation that produces monatomic oxygen and/or ozone from the diatomic oxygen.

59. A method as in claim 57 wherein the removing step is at least partially performed with a liquid chemical etchant.

60. A method as in claim 57 wherein the electron-emissive elements are largely metallic.

* * * * *